US007661897B1

(12) United States Patent
Jackson

(10) Patent No.: US 7,661,897 B1
(45) Date of Patent: Feb. 16, 2010

(54) LOTION APPLICATOR

(76) Inventor: Yvonne W. Jackson, 1018 Dewberry Dr., Fredericksburg, VA (US) 22407

( * ) Notice: Subject to any disclaimer, the term of this patent is extended or adjusted under 35 U.S.C. 154(b) by 39 days.

(21) Appl. No.: 11/986,823

(22) Filed: Nov. 27, 2007

Related U.S. Application Data

(60) Provisional application No. 60/860,939, filed on Nov. 27, 2006.

(51) Int. Cl.
*A46B 5/02* (2006.01)

(52) U.S. Cl. ..... 401/6; 401/183; 401/205

(58) Field of Classification Search ..... 401/6, 401/8, 183–186, 201, 205
See application file for complete search history.

(56) References Cited

U.S. PATENT DOCUMENTS 5,013,171 A 5/1991 Almond, II
5,035,523 A * 7/1991 Allinder ..... 401/6
5,545,456 A 8/1996 Suida
D393,102 S 3/1998 Meier
5,979,006 A 11/1999 Stokes et al.
6,174,297 B1 1/2001 Chen
D440,355 S 4/2001 Nati
6,899,481 B2 5/2005 Katsandres et al.
7,168,873 B2 * 1/2007 Shawan et al. ..... 401/6
7,419,321 B2 * 9/2008 Tereschouk ..... 401/133

* cited by examiner

*Primary Examiner*—David J Walczak
(74) *Attorney, Agent, or Firm*—Robert C. Montgomery

(57) ABSTRACT

A unique apparatus for the application of lotions, balms and creams to a person's back area includes interchangeable applicators each having a removable connection through which lotions is introduced to the applicator. Soft, flexible tubing transmits the lotion throughout the interior of the applicator that, in turn, has a series of small apertures allowing the liquid-based material to be dispersed onto the applicator pad when gently squeezed. In use, a person pulls the pad back and forth across their back using the long straps attached to each end. It is also envisioned that the pad could be supported from a shower wall to allow the user to rub their back against it. One side is the applicator pad while the other side and side edges are coated with a waterproof sealant to keep the material from saturating the side that is not is use.

18 Claims, 7 Drawing Sheets

LOTION APPLICATOR

RELATED APPLICATIONS

The present invention was first described in and claims the benefit of U.S. Provisional Patent Application No. 60/860,939 filed on Nov. 27, 2006, the entire disclosures of which are incorporated herein by reference.

FIELD OF THE INVENTION

The present invention relates generally to an applicator apparatus for applying lotions and, more particularly, to said apparatus providing individuals with the ability of applying lotions to or to scrub their back region in a comfortable manner.

BACKGROUND OF THE INVENTION

Applying a topical liquid whether it is a lotion, soap, oil or other liquid to one's back or other hard to reach area can be a difficult feat. These problems are compounded in individuals with limited flexibility. Another difficulty is applying the liquid evenly and absorbing the excess liquid that is applied. Consequently, there is a need for an apparatus that evenly applies topical liquids to hard toe reach areas of the human body and absorbs excess liquid. The development of the invention herein described fulfills this need.

U.S. Pat. No. 6,899,481 issued to Katsandres et al. discloses a retractable belt lotion applicator. This patent does not appear to disclose an apparatus that possesses an application pad that on one face can evenly disperse topical liquids and on the other face absorb excess liquid nor does the patent appear to disclose an apparatus with the multiple functionality of the instant invention.

U.S. Pat. No. D 440,355 issued to Nati discloses a back scrubber. This design patent differs in appearance from the invention and does not appear to disclose an application pad that on one face can evenly disperse topical liquids and on the other face absorb excess liquid nor does the patent appear to disclose an apparatus with the multiple functionality of the instant invention.

U.S. Pat. No. 6,174,297 issued to Chen discloses a hand-held bath scrubber with massage balls. This patent does not appear to disclose an apparatus that is easily manipulated through the use of straps nor does it appear to disclose an apparatus with the multiple functionality of the instant invention.

U.S. Pat. No. 5,979,006 issued to Stokes discloses a lotion applicator and body massage assembly. This patent does not appear to disclose an apparatus that can distribute topical liquid as desired through a refillable reservoir.

U.S. Pat. No. D 393,102 issued to Meier discloses a lotion applicator. This design patent differs in appearance from the invention and does not appear to disclose an apparatus that possesses an application pad that on one face can evenly disperse topical liquids and on the other face absorb excess liquid nor does the patent appear to disclose an apparatus with the multiple functionality of the instant invention.

U.S. Pat. No. 5,545,456 issued to Suida discloses a wash-cloth that cleans and massages. This patent does not appear to disclose an apparatus that can distribute topical liquid as desired through a refillable reservoir.

U.S. Pat. No. 5,013,171 issued to Almond discloses a body lotion applicator apparatus. This patent does not appear to disclose an apparatus that possesses an application pad that on one face can evenly disperse topical liquids and on the other face absorb excess liquid nor does the patent appear to disclose an apparatus with the multiple functionality of the instant invention.

SUMMARY OF THE INVENTION

In view of the foregoing disadvantages inherent in the prior art, it has been observed that there is need for a means by which an individual can quickly and easily cleanse, and scrub their back area of their body and/or apply lotion.

The lotion applicator provides a convenient way to evenly apply soap or lotion to one's back.

The lotion applicator comprises an application pad, an internal tube-like reservoir with a plurality of dispersing apertures and straps.

The lotion applicator possesses an application pad can be constructed from any absorbent and stretchable material such as but not limited to, terry cloth in a variety of colors or motifs.

The lotion applicator possesses an application pad that can be of any geometric shape such as but not limited to, cylindrical or rectangular.

The lotion applicator application pad is composed of a top cover and a bottom cover.

The lotion applicator application pad possesses on its bottom cover a reservoir that contains the ability and capacity to store and dispense topical treatments such as but not limited to soap and/or lotion.

The lotion applicator application pad on its bottom cover contains a plurality of dispersing apertures operably positioned along the partial or complete span of the reservoir.

The lotion applicator reservoir comprises a soft flexible tube-like structure that is capable of being refilled with topical treatments such as but not limited to soap and lotion.

The lotion applicator reservoir possesses a closing cap which can be removed for the introduction of liquid topical treatments and the sealing of the reservoir.

The lotion applicator application pad on its top cover possesses a pad which is composed of an absorbent flexible material that possesses the ability to absorb excess lotion and/or soap that is present on the skin.

The lotion applicator provides a set of straps for manual manipulation of the applicator on ones body.

The lotion applicator straps are permanently attached to the application pad by means of sewing, seaming, adhering or other embedding means.

The lotion applicator straps comprise a durable and resilient material and may be elastic.

The lotion applicator straps each possess a distal and proximal end.

The lotion applicator straps at their proximal end are attached to the application pad while at the distal end may possess hooks or other fastening means to enable the lotion applicator to be suspended when not in use as an applicator.

The lotion applicator may be suspended with a fragrant material in the reservoir to act as an air freshener.

The lotion applicator application pad may, in alternative embodiments, be designed in various shapes such as but not limited to, sport team logos, cartoon characters and animal caricatures.

The lotion applicator application pad, in alternate embodiments may have differing textures on opposing sides of the pad to provide different effects to the topical treatments contained in the reservoir.

The lotion applicator may, in an alternate embodiment employ massaging beads, balls or other objects integrated into the application pad to impart a massaging effect to the apparatus when used.

The lotion applicator may, in an alternate embodiment possesses handles at the distal ends of the straps.

The lotion applicator is designed to administer measured amounts of topical treatments such as but not limited to, soaps, lotions, gels, body wash, creams, balms or oils to hard to reach areas of the body.

The prior art appears to disclose apparatuses which can be utilized on hard to reach areas of the body. The prior art does not appear to disclose an apparatus that can evenly and easily distribute topical liquids on hard to reach areas of the body and absorb the excess liquid.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

| DESCRIPTIVE KEY | |
|---|---|
| 10 | lotion applicator |
| 20 | application pad |
| 21 | application pad bottom and side cover |
| 22 | application pad top cover |
| 23 | application pad sponge |
| 25 | protrusion |
| 30 | reservoir |
| 32 | open front face |
| 33 | closing cap |
| 35 | dispersing aperture |
| 40 | strap |
| 50 | hook fastener |
| 51 | loop fastener |
| 52 | snap button |
| 53 | grip |
| 60 | lotion |
| 70 | beads or rollers |
| 100 | user |

DETAILED DESCRIPTION OF THE PREFERRED EMBODIMENT

Figure 2:
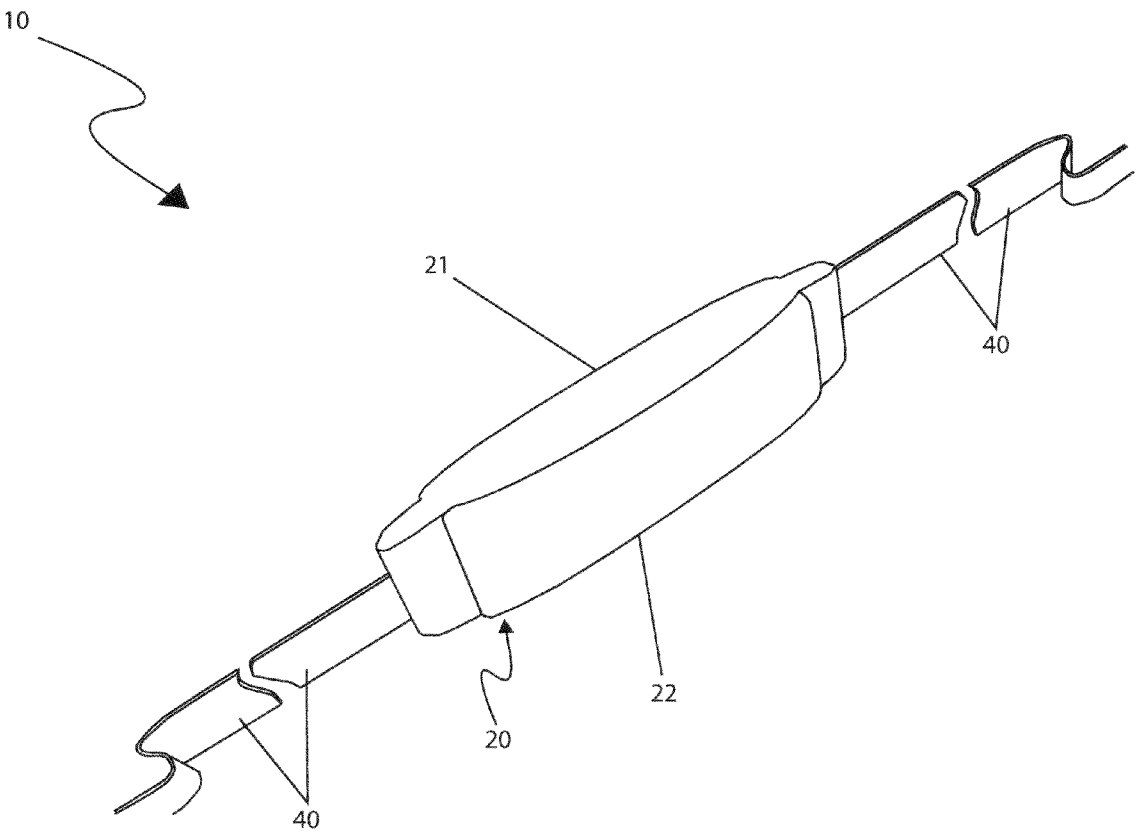
FIG. 2 is a top perspective view of a lotion applicator 10, according to the preferred embodiment of the present invention.
Figure 3A:
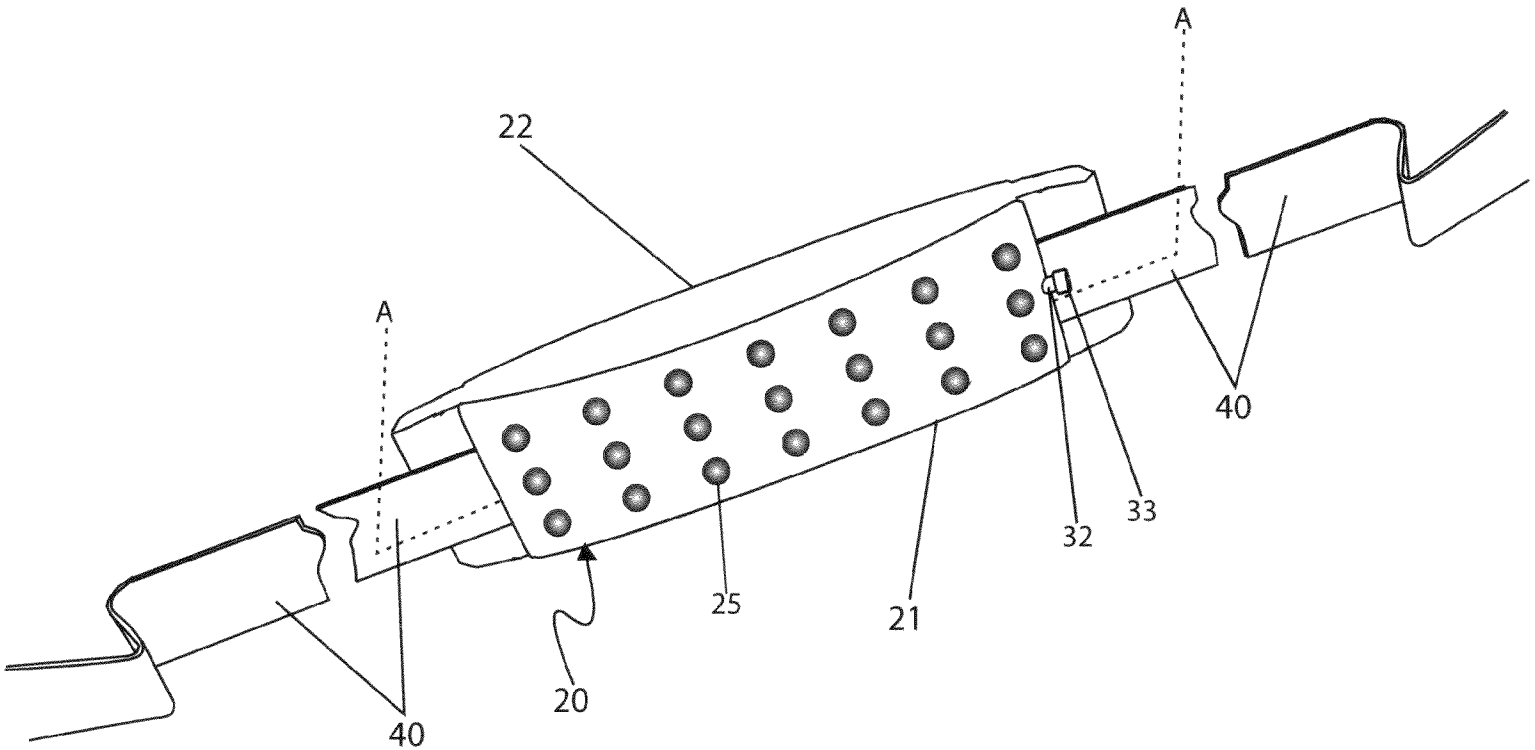
FIG. 3*a* is a bottom perspective view of the lotion applicator 10, according to the preferred embodiment of the present invention.
Figure 3B:
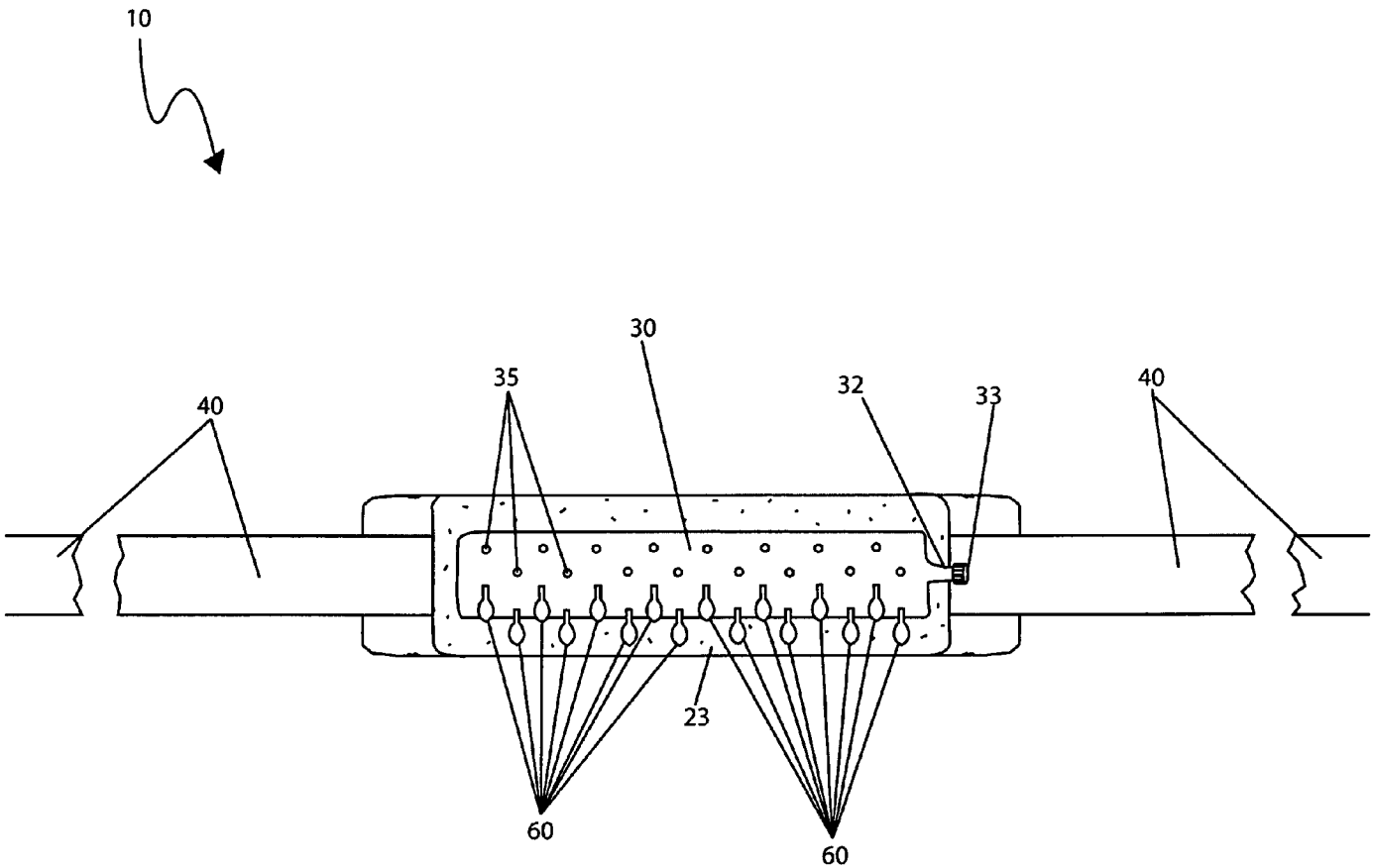
FIG. 3*b* is a bottom cut-away view of the lotion applicator 10, according to the preferred embodiment of the present invention.
Figure 4:
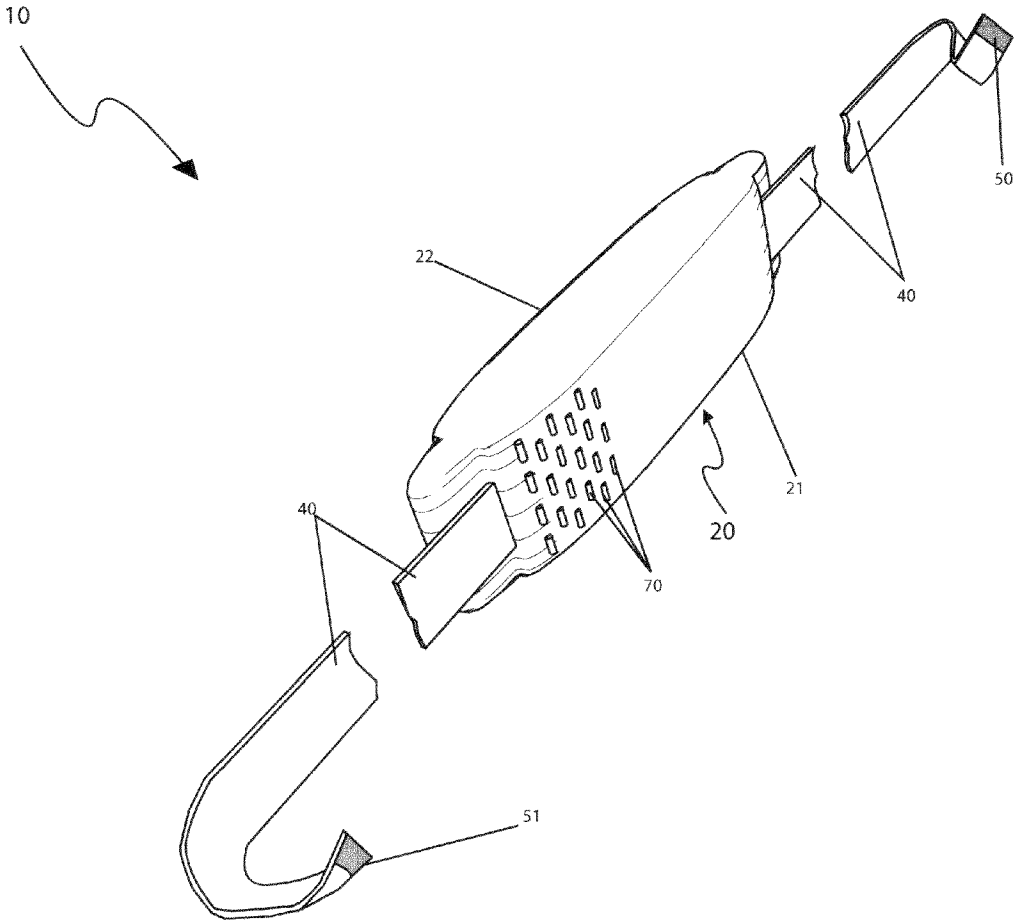
FIG. 4 is a bottom perspective view of the lotion applicator 10, according to the alternate embodiment of the present invention.
Figure 5A:
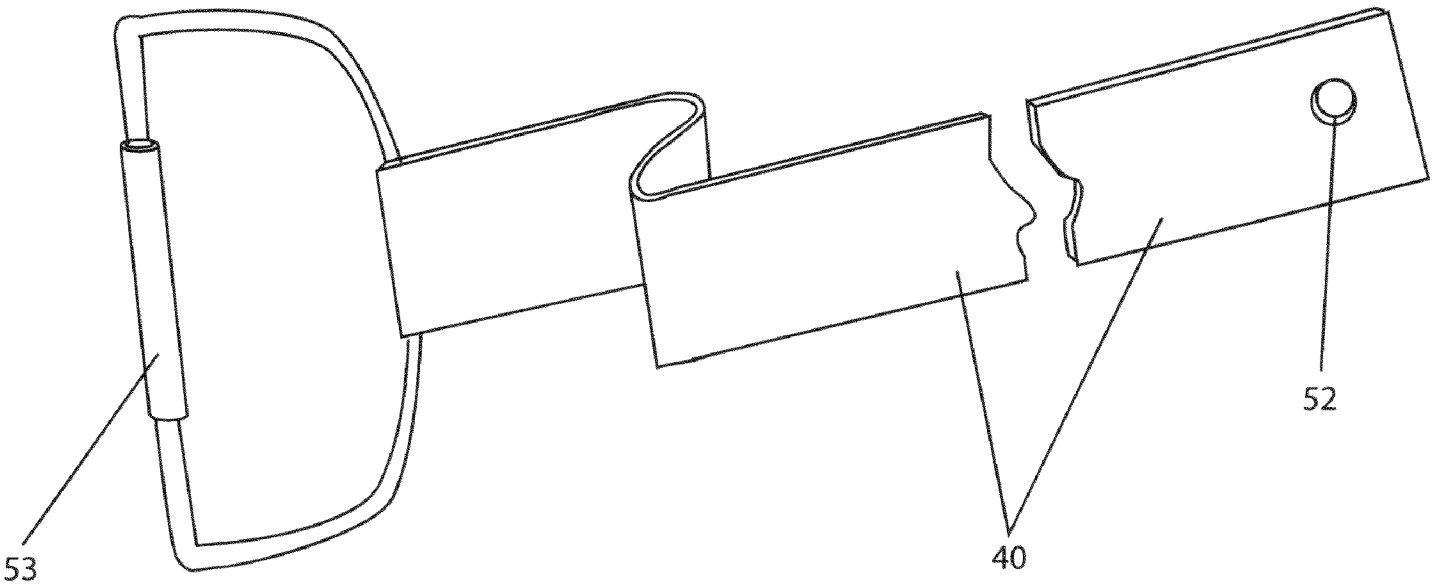
FIG. 5*a* is a top perspective view of the lotion applicator 10, according to the alternate embodiment of the present invention; and, FIG. 5*b* is a top perspective view of the lotion applicator 10, according to the alternate embodiment of the present invention.
Figure 5B:
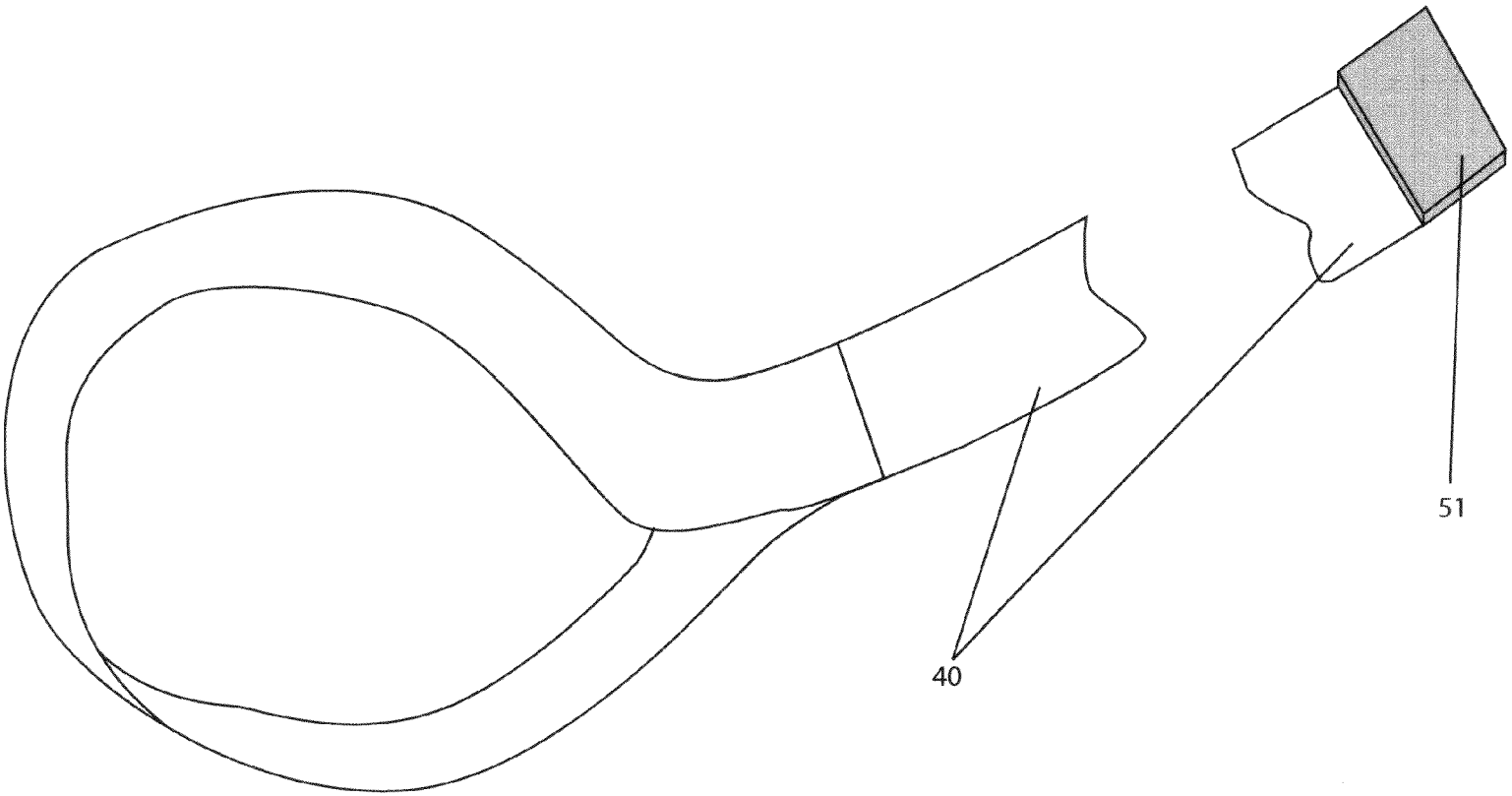

The best mode for carrying out the invention is presented in terms of its preferred embodiment, herein depicted within FIGS. 1 through 3*b*, with an alternate embodiment depicted within FIGS. 4 through 5*b*. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method that discloses a lotion applicator 10 for the application of lotions 60, balms, creams, and the like to the skin of a person, especially the back area or other hard-to-reach areas. The lotion applicator (herein described as the "device") 10 comprises an application pad 20, an internal tube-like reservoir 30 comprising a plurality of dispersing apertures 35, and straps 40. The main components such as the pad 20 are envisioned to be fabricated of a terry cloth or other similar material enveloping a sponge or foam pad or the like that would be cut to size and sewn together; however, the device 10 can be fabricated out of any material or combination thereof from absorbent and stretchable to abrasive. However, the materials utilized for the device 10 are envisioned to be made from any suitable flexible material having a comfortable degree of porosity whilst still being absorbent, soft, and comfortable and providing structural integrity and strength for continuous and repeated use. It is also envisioned that multiple colors and styles would be made available to match all bathroom decors or the like.

Figure 1:
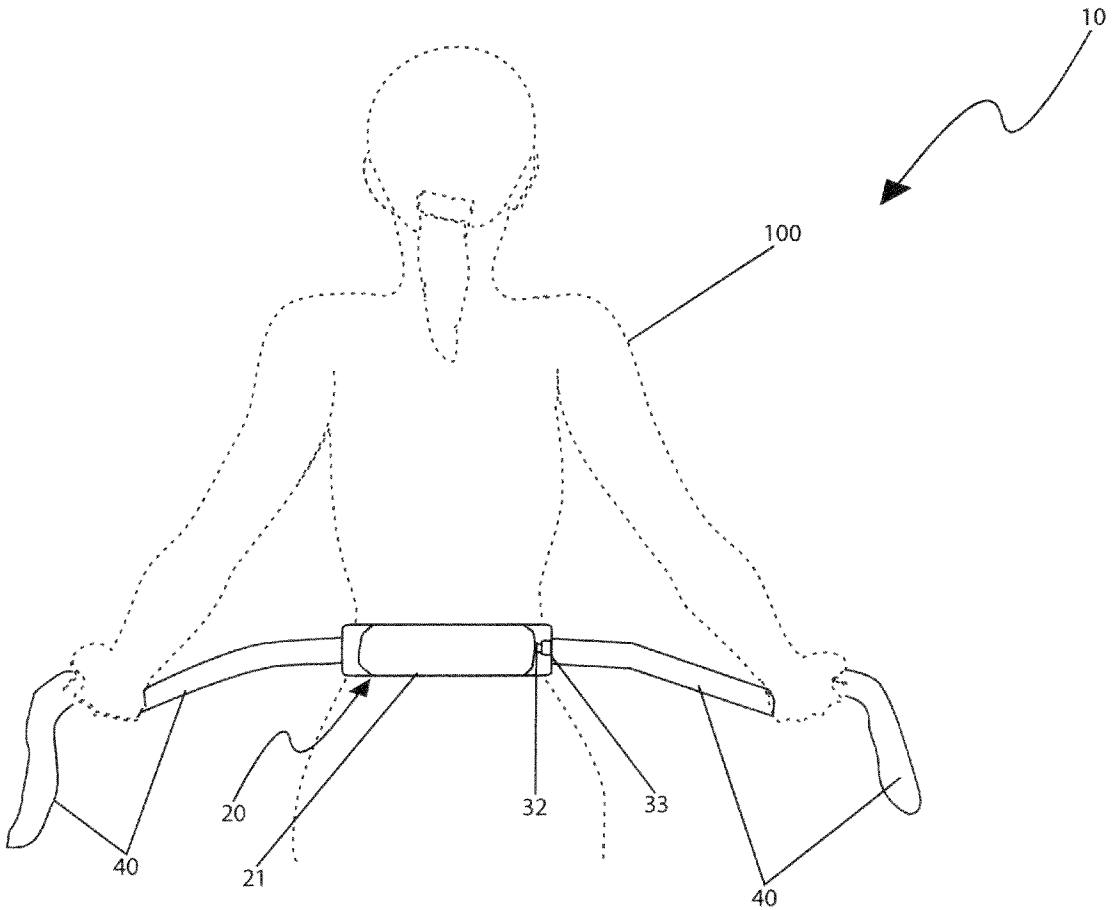
FIG. 1 is a environmental view of a lotion applicator 10, according to the preferred embodiment of the present invention.

Referring now to FIG. 1, an environmental view of the device 10 is disclosed according to the preferred embodiment of the present invention. The device 10 comprises an application pad 20, a reservoir 30, an open front face 32, a closing cap 33, and straps 40.

Referring now to FIG. 2, a top perspective view of the device 10 is disclosed according to the preferred embodiment of the present invention. The device 10 is envisioned to comprise an application pad 20 that is substantially rectangular with two (2) opposed longitudinal sides, two (2) opposed lateral sides, a top side, and a bottom side. The application pad 20 is envisioned to be fabricated of rectangular-shaped application pad sponge 23 in a plurality of dimensions; however, the application pad 20 may also comprise a plurality of protrusions 25 (see FIG. 3*a*) such as, but not limited to: cylindrical, square, or other shapes. The application pad top cover 22 is comprised of terry cloth or the like and is envisioned to be the lotioning surface. The application pad bottom and side cover 21 comprises terry cloth or the like and is envisioned to be coated with a waterproof sealant to keep the lotion 60 from saturating the side that would not see use. The application pad top cover 22 and the application pad bottom and side cover 21 envelope an application pad sponge 23 or pad for applying lotions 60, gels, liquid soaps, body wash, balms, creams, oils, and similar substances and a reservoir 30 that contains and distributes the lotions 60, gels, liquid soaps, body wash, balms, creams, oils and similar substances throughout the application pad sponge 23 and thereby throughout the application pad top cover 22. The terry cloth or other fabricated surface is preferably washable allowing a user to selectively apply lotions 60, gels, liquid soaps, body wash, balms, creams, oils, or other substances. Alternatively, the bottom side and/or the longitudinal and lateral sides may comprise protuberances 25 or the like to utilize as a massaging device.

Referring now to FIG. 3*a*, a bottom perspective view, and FIG. 3*b*, a cut-away bottom view (section A-A from FIG. 3) of the device 10, are disclosed according to the preferred embodiment of the present invention. The device 10 comprises an application pad 20, an application pad top cover 22, an application pad bottom and side cover 21, an application pad sponge 23 enclosing a reservoir 30, a reservoir open front face 32, and a closing cap 33.

The application pad 20 is envisioned to comprise a reservoir 30 that contains the ability and capacity to store and dispense lotion 60. The reservoir 30 retains a quantity of lotion 60 or the like therewithin for directing and subsequent application of the lotion 60 onto an individual utilizing a plurality of dispersing apertures 35 integrally distributed thereon. A plurality of dispersing apertures 35 is operably positioned therealong the partial or complete span of said reservoir 30. The dispersing apertures 35 are preferably, but not essentially, spaced therealong the top side of the application pad 20. The reservoir 30 is envisioned to resemble a soft, flexible tubing that can be refilled with lotion 60, soap, cream, and so on. The reservoir 30 defines an interior compartment for housing the lotion 60 with an open front face 32 for receiving refillable lotions 60 or other desirable fluids. The reservoir 30 comprises an open front face 32 to permit introduction of a lotion 60 interiorly therein the reservoir 30, and hence the application pad 20. The open front face 32 of the reservoir 30 comprises an outer wall defining a threaded or grooved region positioned at the upper opening for receiving and cooperating with the enlarged end portion of a closing cap 33 to secure in place. The closing cap 33 comprises an inside wall defining a bore for receiving the threaded region of the open front face 32. The enlarged end portion of the closing cap 33 engages the threaded region thereby closing the open front face 32 of the reservoir 30.

Straps 40 are affixed thereto on each side of the application pad 20 by means of sewing, seaming, adhering, or other embedded means. The straps 40, permanently attached thereto the application pad 20, are envisioned to be a plurality of lengths, widths, and/or other dimensions. The straps 40 are preferably, but not essentially, elastic, comprising of one (1) or more pieces of durable and resilient material. The straps 40 are envisioned to comprise two (2) ends, a distal end and a proximal end. The proximal end is attached thereto the respective side of the application pad 20 and the distal end may also comprise attachment means thereon each end, such as, but not limited to, hook-and-loop fasteners 50 and 51, snaps 52, or the like to attach one (1) strap 40 with the other to form a loop to suspend on fixtures such as a hook, for example, for hanging or holding for storage when not in use, for the quick drying of device 10, for hanging the device 10 as decoration, or fragrantly odorize the air with essence when fragrant items are placed therein the device 10 if desiring to utilize the device 10 as an air freshener.

The device 10 may also be introduced with a variety of aesthetically pleasing décor and/or motifs with or without images such as, but not limited to, cartoon characters, sport logos, and/or other caricatures. The application pad 20 may also be introduced in a variety of shapes and sizes with or without the option of it being fashioned to resemble effects such as, but not limited to, animals, characters, and/or other images. The device 10 may be introduced in a plurality of shapes capable of enclosing a reservoir 30.

Referring now to FIG. 4, FIG. 5*a*, and FIG. 5*b*, top perspective views of the device 10 are disclosed according to alternate embodiments of the present invention. It is envisioned that the application pad 20 comprises an application pad top cover 22, and an application pad bottom and side cover 21, which can be provided with a plurality of textured qualities in a variety of and/or combination of materials which may permit said pad 20 to be interchangeably used as a bathing or massaging device. For example, one (1) side of the application pad 20 may comprise a softer material with the opposing side comprising material slightly more abrasive. The abrasive side may be prepared by utilizing protuberances 25 of various sizes and shapes, such as, but not limited to: conical, rounded, other desirable shapes, and a combination thereof. The protuberances 25 may be facing inward or outward with regards to the reservoir 30. The material is also envisioned to permit water passage therethrough the application pad top cover 22 for procuring a lathering effect during utilization of device 10. The textured application pad 20 type and size are envisioned to vary in accordance with the type of lotion 60, release rate of lotion 60 or other substance, capability of rinsing with ease, amount of lather desired, and/or other user preferences. The straps 40 may also be removably affixed to the application pad 20 by means such as but not limited to hook and loop fasteners 50 and 51, snap buttons 52, or the like. Also, the device 10 may be used as a massaging agent by means of massaging beads 70, balls, or other objects integrated on one (1) or more sides of the application pad 20 to provide a quick, convenient therapeutic massage.

Another alternate embodiment of the present invention may provide handles integrally attached at the distal end of the straps 40 such that the user may more easily hold to motion the application pad 20 to both clean and massage the back or other hard-to-reach places of the body. The handles may further comprise a sleeve or the like providing a soft, comfortable grasping surface for the user.

The preferred embodiment of the present invention can be utilized by the common user in a simple and effortless manner with little or no training. After initial purchase or acquisition of the device 10, it would be configured as indicated in FIGS. 1, 2, and 3*a*.

The method of utilizing the preferred embodiment of the device 10 may be achieved by performing the following steps: grasping one (1) end of the first strap 40 with the first hand; lifting and/or flinging the device 10 over one (1) shoulder and then down over the back of the user 100; grasping one (1) end of the second strap 40 with the second hand such that the application pad top cover 22 is against user's 100 back; motioning the application pad 20 over the back of the user by gliding upwardly, downwardly, sidewardly, rotationally, and a plurality of other directions by moving the arms, consequently the straps 40, in unison and/or keeping one (1) arm stationary and motioning the opposing arm; releasing the first or second hand off of the first or second strap 40; bringing forth the device 10 to the front of the body; rinsing or cleaning the application pad 20, if needed; refilling the reservoir 30 with lotion 60 or other desirable fluid, if needed; and, storing appropriately.

The device 10 is envisioned to administer measured amounts of lotions 60, gels, liquid soaps, body wash, balms, creams, oils, and/or similar substances to the back and/or other hard-to-reach areas such as, but not limited to, neck, shoulders, legs, and the like of the user. Unique motions are used to manipulate on the desired skin surfaces for the application of lotions 60. In use, the straps 40 are grasped in both hands with the application pad 20 comprising a predetermined quantity of lotion 60 directed within the reservoir 30. The reservoir 30 resides therein the application pad 20 and is preferably flexible for easy manipulation, refillable, and washable. The reservoir 30 comprises a plurality of dispersing apertures 35 for lotion 60 to flow therethrough to saturate the application pad 20 to deliver a measured quantity of the lotion 60, massage, rub, and/or exfoliate the user. The application pad 20 collects the dispensed lotion 60 therefrom the dispersing apertures 35 and said pad 20 absorbs to reduce and minimize excess lotion 60 from escaping during application thereon the desired skin surface.

Essentially, the device 10 is utilized for the application, dispensing, and affection of the application of the lotion 60 to skin areas, specifically hard-to-reach areas 15 such as, but not limited to, the back, shoulders, and legs. The application pad 20 is sized and designed for a smooth and comfortable application while still being washable and easily stored.

The alternate embodiment of the present invention can be utilized by the common user in a simple and effortless manner with little or no training. After initial purchase or acquisition of the device 10, it would be configured as indicated in FIGS. 1, 4, and 5*a* and 5*b*.

The method of utilizing the alternate embodiment of the device 10 may be achieved by performing the following steps: grasping one (1) end of the first strap 40 with the first hand; lifting and/or flinging the device 10 over one (1) shoulder and then down over the back of the user 100; grasping one (1) end of the second strap 40 with the second hand such that the application pad bottom and side cover 21 is against user's 100 back; motioning the application pad 20 over the back of the user by gliding upwardly, downwardly, sidewardly, rotationally, and a plurality of other directions by moving the arms, consequently the straps 40, in unison and/or keeping one (1) arm stationary and motioning the opposing arm; releasing the first or second hand off of the first or second strap 40, thereby providing the desired massage.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An applicator for applying a substance to a body surface of a user comprises:

a reservoir for receivably containing said substance therein;

an open front face with a closure cap in fluid communication with said reservoir;

a plurality of dispersing apertures operably positioned along said reservoir and in fluid communication with said reservoir;

an application pad enveloping said reservoir; and, a first strap and a second strap affixed to said application pad;

wherein said open front face provides a filling means for introducing said substance into said reservoir;

wherein said plurality of dispersing apertures provides a dispensing means for dispensing said substance out of said reservoir;

wherein said application pad receives said substance as dispensed from said reservoir for subsequent application thereto said body surface; and, wherein said user manipulates said applicator by grasping said first and second straps and applies pressure to said reservoir.

2. The applicator of claim 1, wherein said reservoir comprises a soft, flexible tubular structure.

3. The applicator of claim 1, wherein said application pad further comprises:

a generally rectangular sponge, comprising said application pad having an inner side, an outer side, a top side, a bottom side, a first strap side, and a second strap side;

an application pad top cover; and, an application pad bottom and side cover;

wherein said inner side receives said substance from said plurality of dispersing apertures.

4. The applicator of claim 3, wherein said application pad top cover comprises a terry cloth material.

5. The applicator of claim 3, wherein said application pad bottom and side cover comprise a terry cloth material with a waterproof sealant.

6. The applicator of claim 3, wherein said application pad further comprises a plurality of protuberances located on said inner side of said application pad to provide a massaging means.

7. The applicator of claim 3, wherein said application pad top cover and said application pad bottom and side cover comprise a different textured material to provide a contrasting usage means.

8. The applicator of claim 1, wherein said first and second straps each comprise:

an elastic, durable and resilient material;

a proximal end attached to a respective first strap side and a second strap side of said application pad; and, a distal end.

9. The applicator of claim 8, wherein said first and second straps further comprise corresponding fastening means on said distal ends.

10. The applicator of claim 8, wherein said first and second straps further comprise respective first and second handles on said distal ends.

11. An applicator for applying a substance to a body surface of a user comprises:

a reservoir for receivably containing said substance therein, further comprising:

an open front face with a closure cap in fluid communication therewith said reservoir;

a plurality of dispersing apertures operably positioned along said reservoir at locations spaced and in fluid communication with said reservoir;

an application pad enveloping said reservoir, said application pad further comprising:

an application pad sponge, wherein said application pad comprises an inner side, an outer side, a top side, a bottom side, a first strap side, and a second strap side;

a plurality of protuberances located on said inner side of said application pad;

an application pad top cover; and, an application pad bottom and side cover;

a first strap affixed to said first strap side; and, a second strap affixed to said second strap side wherein said first and second straps each comprises:

an elastic, durable, and resilient material;

a proximal end attached to a respective first strap side and a second strap side of said application pad; and, a distal end;

wherein said reservoir has smooth front and back sides for directly contacting said substance respectively during application of said substance to said body surface.

12. The applicator of claim 11, wherein said reservoir comprises a soft and flexible tubular construction.

13. The applicator of claim 11, wherein said application pad comprises a generally rectangular structure.

14. The applicator of claim 11, wherein said application pad top cover and application pad bottom and side cover comprise a different textured material to provide a contrasting usage means.

15. The applicator of claim 11, wherein said application pad top cover and said application pad bottom and side cover comprise a terry cloth material.

16. The applicator of claim 15, wherein said application pad bottom and side cover further comprise a terry cloth material.

17. The applicator of claim 11, wherein said first and second strap straps further comprise an elastic and durable material.

18. The applicator of claim 17, wherein said first and second straps further comprise corresponding fastening means on said distal ends.

* * * * *